US007036230B1

(12) United States Patent
Liaw

(10) Patent No.: US 7,036,230 B1
(45) Date of Patent: May 2, 2006

(54) CUTTING TOOL ADOPTED FOR TWO HANDED OPERATION

(75) Inventor: Jian-Shiou Liaw, Taichung (TW)

(73) Assignee: K.K.U. Limited, Tokyo (JP)

( * ) Notice: Subject to any disclaimer, the term of this patent is extended or adjusted under 35 U.S.C. 154(b) by 619 days.

(21) Appl. No.: 09/652,268

(22) Filed: Aug. 31, 2000

(30) Foreign Application Priority Data

Jan. 27, 2000 (CN) ..... 89201440 U

(51) Int. Cl.
*B23D 51/01* (2006.01)

(52) U.S. Cl. ..... 30/390; 30/517; 30/296.1

(58) Field of Classification Search ..... 30/390, 30/391, 517, 518, 519, 520, 521, 522, 523, 30/524, 525, 249, 296.1; 173/161, 170, 171; 16/422, 427, 429; 81/177.2
See application file for complete search history.

(56) References Cited

U.S. PATENT DOCUMENTS

| | | | | | |
|---|---|---|---|---|---|
| 1,124,552 | A | * | 1/1915 | Suggs | 30/296.1 |
| 1,806,582 | A | * | 5/1931 | Beutner | 30/390 |
| 2,342,052 | A | * | 2/1944 | Jimerson et al. | 30/263 |
| 4,179,805 | A | * | 12/1979 | Yamada | 172/41 |
| 4,347,880 | A | * | 9/1982 | van der Merwe | 144/24.13 |
| 4,661,009 | A | * | 4/1987 | Tripp | 279/157 |
| 4,803,904 | A | * | 2/1989 | Stanich et al. | 81/177.2 |
| 5,406,866 | A | * | 4/1995 | Badiali | 81/57.3 |
| 5,582,041 | A | * | 12/1996 | Spiess | 30/276 |
| 5,709,136 | A | * | 1/1998 | Frenkel | 81/57.13 |
| 6,055,887 | A | * | 5/2000 | Galat | 81/177.2 |
| 6,151,994 | A | * | 11/2000 | Shiao | 81/438 |

OTHER PUBLICATIONS

Cutters Power Tools, Air, AT155, 3" cutter and AT156, 3" cut–off tool, p. 237.
Chicago Pneumatic, Tire buffers/Cut–Off Tools, CP–861 High Speed Cutter–Heavy Duty and CP874, High Speed Cutter–General Duty, p. 23.
Craftsman, Air Drive Tools . . . less effort, great results, (H) NEW! High–speed Cutter Tool with 6 cut–off wheels . . . redesigned for better comfort and control, p. 110.
MacTool, Air Tools–Cut–Off & Specialty Tools, Five Ways to Make the Cut, AMT3BK–Flex Head Cut–Off Tool Kit; AMT300B–FLex Head Cut–Off Tool; AMT275C–Mini Saw/Cut–Off Tool; AMTR275–Reversible Cut–Off Tool, p. 168.
Matco, Specialty Air Tools S19, RL500.
Sunex Air Tools, Air Cutting Tools & Grease Gun, SX233A, Utility Cut–Off Tool with Guard, p. 39.
Astro, Cut–Off Tool & Accessories, (207) 3" Cut–Off Tool with Safety Lever; (1201) 3" Composite Body Cut–Off Tool with Safety Lever, p. 25.
Sioux Tools Inc., Force, Cut–Off Tool, Model No. 5564, p. 114.
Ingersoll–Rand, Air Cutting Tools and Grinders, IR326 Heavy Duty Air Cut–Off Tool.

* cited by examiner

*Primary Examiner*—Stephen Choi
(74) *Attorney, Agent, or Firm*—Greer, Burns & Crain,Ltd.

(57) ABSTRACT

A pneumatic cutting tool has an extended body length so it can be operated by a pair of hands to facilitate the operation and holding thereof The body length can be increased using an extension cylinder and extension kit. The tool also has a handle mounted onto the periphery of the extended body length. The handle can be moved to any suitable axial and radial position on the body, and secured by tightening a threaded rod in the handle.

4 Claims, 3 Drawing Sheets

CUTTING TOOL ADOPTED FOR TWO HANDED OPERATION

FIELD OF THE INVENTION

The present invention relates generally to a pneumatic tool, and more particularly to a pneumatic cutting tool adapted for two handed operation.

BACKGROUND OF THE INVENTION

A conventional pneumatic cutting tool is shown in FIG. 3, and generally includes a body 60 housing a motor (not illustrated) which drives a shaft 61. A protecting cover 65 is provided at an operating end 80 of the body 60. A connecting tube 67 is further provided with one end connected to the shaft 61. A relatively larger positioning collar 68 is defined on the connecting tube 67. The positioning collar 68 has a protrusion part 69, with inner thread 70, where a bolt 72 attaches a circular cutter 71 to the connecting tube 67. In operation, the motor drives the shaft 61, connecting tube 67 and the cutter 71, to rotate the cutter and perform the operation of cutting.

The conventional cutting tool provides convenient one-handed operation, but does not permit operation using two hands. However, one-handed operation is problematic as it easily affects the quality of work performed by the tool. Specifically, it is difficult to control vibrations of the tool, and consequently the precise shape of the article being cut. Moreover, single-handed operation is strenuous, which leads to operator fatigue. In addition to affecting the quality of work, there is a risk that the pneumatic cutting tool will slip out of the operator's single hand, which could have undesired consequences.

Accordingly, one object of the present invention is to provide an improved pneumatic cutting tool that can be gripped with both of the operator's hands to provide greater stability, and to eliminate the above-mentioned disadvantages.

Another object of the present invention is to provide an adjustable handle for a cutting tool, enabling convenient gripping of the tool in a plurality of positions.

SUMMARY OF THE INVENTION

The above-listed objects are met or exceeded by the present invention, in which a cutting tool has an extended length facilitating two-handed gripping of the tool. This results in greater stability during the operation of the tool, and facilitates the cutting operation.

A first objective of the present invention is to provide a cutting tool having an extended length. The length of the cutting tool is suitably configured to conveniently allow two handed support of the cutting tool during operation, providing better stability and control in cutting.

Another objective of the present invention is to provide a pneumatic cutting tool having an adjustable handle for accommodating the preferred positions of various operators using the tool.

More specifically, the present invention provides a pneumatic cutting tool having an extended length, including a body which has an opening defined therein, and a shaft rotatably mounted to and extended out of the opening of the body. A first connecting tube is connected to the shaft at one end and an extension rod is connected to the other end of the first connecting tube. One end of a cylinder is connected to the opening of the body at the opening, and a protecting cover is fitted on the other end of the cylinder. The extension rod is rotatably fitted inside the cylinder. A second connecting tube is connected to the other end of the extension rod, and to a positioning collar. A circular cutter is fitted onto the positioning collar.

According to one embodiment, the pneumatic cutting tool has a handle assembly which includes a rotatable tube having a handle attached that is slidably mounted onto the periphery of the cylinder. The position of the handle can be adjusted by loosening a threaded rod and moving the rotatable tube along the cylinder.

BRIEF DESCRIPTION OF THE DRAWINGS

The present invention will be more clearly understood from the description as set forth below with reference to the accompanying drawings, wherein.

DETAILED DESCRIPTION OF THE INVENTION

Figure 1:
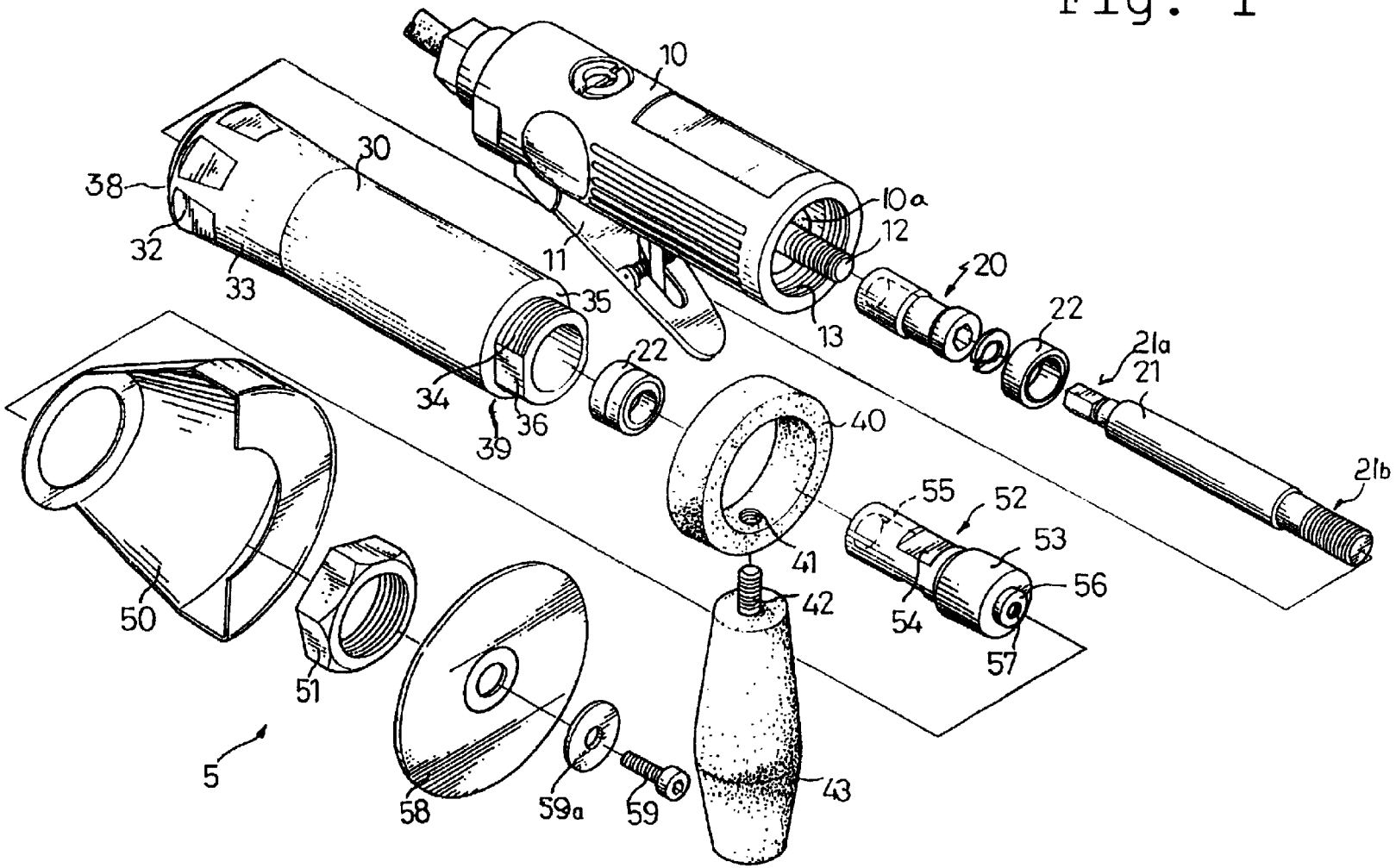
FIG. 1 is an exploded perspective view of a pneumatic cutting tool in accordance with the present invention.
Figure 2:
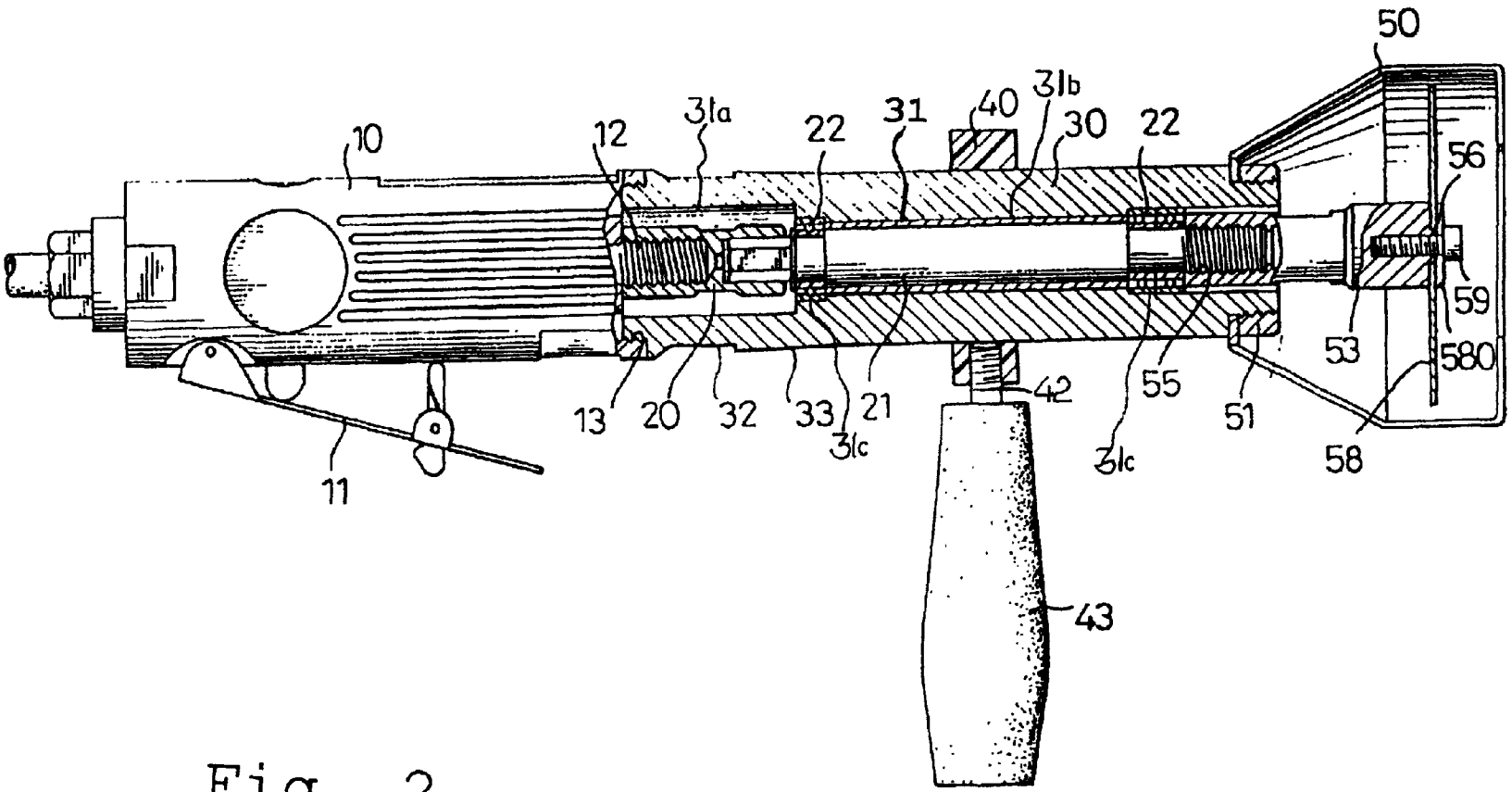
FIG. 2 is a partial side view of the pneumatic cutting tool of FIG. 1, shown in partial cross-section.

As shown in FIGS. 1 and 2, a pneumatic cutting tool includes a body 10 having a trigger 11 extending from it, and an opening 10*a* defined therein. The inner wall of the opening 10*a* has an inner thread 13. A shaft 12 extends out of the body 10 through the opening 10*a*, and is connected to a connecting tube 20. The body 10 also houses a motor, which rotates the shaft 12.

According to a preferred embodiment, the connecting tube 20 is screwed onto a threaded portion of the axle 12. An extension rod 21 is then connected to the connecting tube 20. Ends 21*a* and 21*b* of the extension rod 21 are each provided with a bearing 22.

A cylinder 30 which is long enough to grasp in a hand, has a body end 38 and an operating end 39. The body end 38 is connected to the body 10. According to a preferred embodiment, the body end 38 engages the inner thread 13 of the body 10.

The cylinder 30 has a through hole 31 (FIG. 2) which receives the connecting tube 20 and the extension rod 21. The through hole 31 can have two parts 31*a* and 31*b* which respectively receive the connecting tube 20 and the extension rod 21. The through hole 31 also has parts 31*c* which allow the two bearings 22 to support the extension rod 21 in the through hole 31 of the cylinder 30. According to a preferred embodiment, through hole part 31*a* has a greater diameter than through hole part 31*b*.

In addition, the outer periphery of the cylinder 30 at its body end 38 has many facets 32 formed thereon and a tapered part 33 surrounding the facets 32, such that the cylinder 30 can be easily attached to or detached from the body 10 using a wrench or the like.

The outer periphery of the cylinder 30 has an outer thread 34 defined on the operating end 39. A circular radial surface 35 is formed at the operating end 39 proximate the outer thread 34. Two facets 36 are formed in the outer thread 34 in a facing relationship to one another.

According to a further aspect of the preferred embodiment, a handle assembly including a rotatable tube 40 and a handle 43 is slidably mounted on the cylinder 30.

Preferably, the rotatable tube 40 has a threaded hole 41 configured to receive a threaded rod 42. The handle 43 is connected to the threaded rod 42. Thus, the threaded rod 42 secures the handle 43 to the rotatable tube 40. The threaded rod 42 extends through the threaded hole 41 when the handle is tightened, to fix the rotatable tube 40 in a given position.

A cutting mechanism 5 includes a protecting cover 50 which slips over the outer thread 34 to abut the radial surface 35 of the cylinder 30. A nut 51 fixedly locks the protecting cover 50 onto the cylinder 30. A connecting tube 52 is provided with a positioning collar 53 on one end and two facets 54 on the other end. An inner thread 55 is defined inside the connecting tube 52 near the facets 54, and is configured to engage end 21*b* of the extension rod 21.

A protrusion part 56 of the connecting tube 52 is provided with an inner thread hole 57 located in the central part thereof. A circular cutter 58 has a central opening to allow itself to fit around the periphery of the protrusion part 56. A bolt 59 is provided to pass through a washer 59*a* and screw into the central thread part 57 of the protrusion part 56, such that the washer 59*a* is allowed to lock the circular cutter 58 onto the connecting tube 52.

Referring once again to FIGS. 1 and 2, according to the preferred working position of an operator, the handle 43 can be moved to a suitable location along the outer periphery of the cylinder 30. Loosening the handle 43 disengages the threaded rod 42 from the outer periphery of the cylinder 30, permitting the rotatable tube 40 to be freely moved to a desired axial and radial position on the cylinder 30. Then, tightening the handle 43 engages the threaded rod 42 with the outer periphery of the cylinder 30, which fixes the handle 43 in the desired position.

In operation, the trigger 11 commences the motor to drive the shaft 12 together with the extension rod 21, such that the extension rod 21 can simultaneously drive the connecting tube 52 to drive the circular cutter 58 to rotate and perform the cutting operation. Only one hand is required to actuate the trigger 11, while the other hand grips the handle 43. By using two hands for the cutting operation of the pneumatic cutting tool in accordance with the present invention, the cutting forces and vibrations are effectively diminished, resulting in higher efficiency and stability of the cutting operation.

Figure 3:
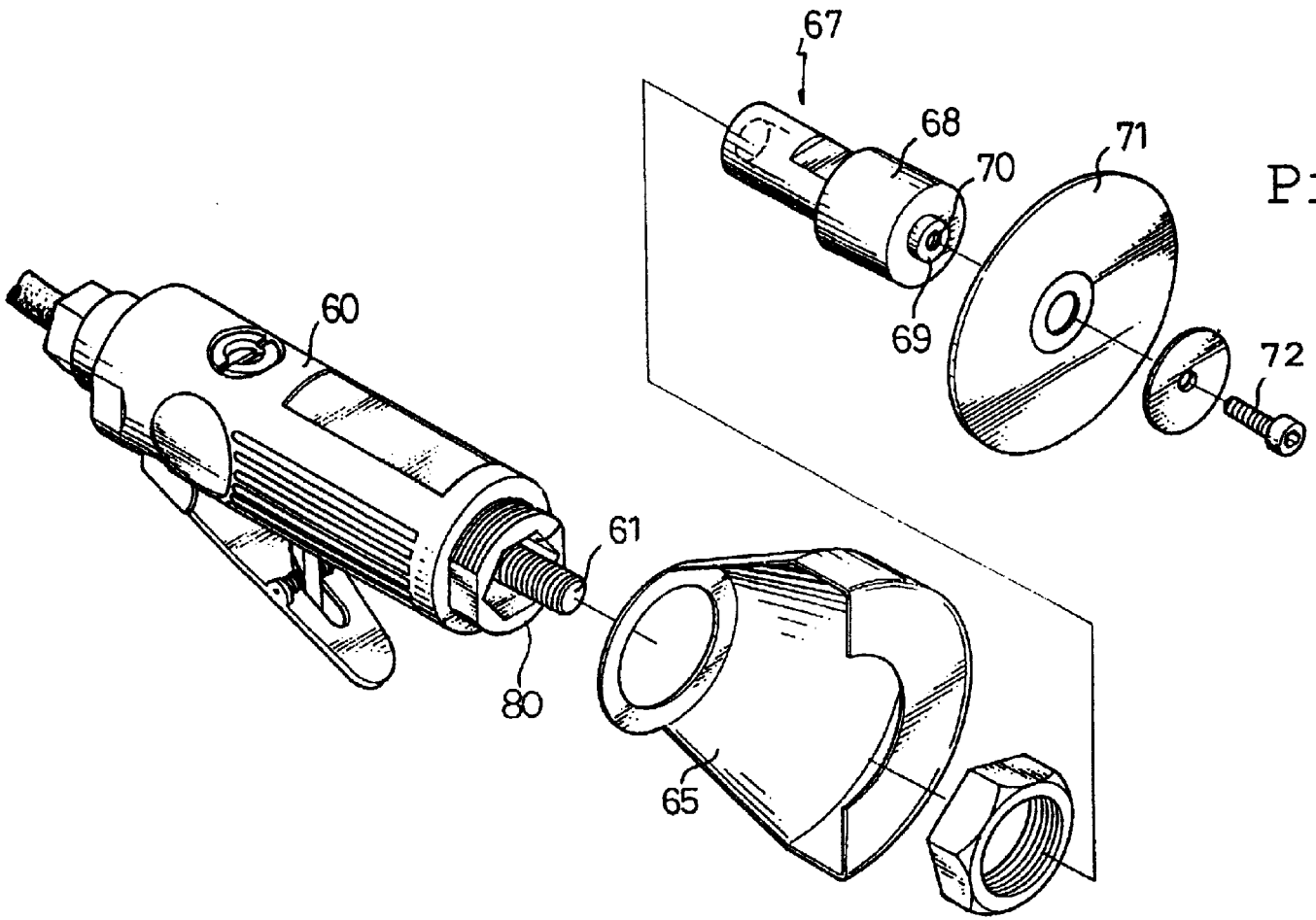
Fig. 3 Prior Art
FIG. 3 is an exploded perspective view of a conventional pneumatic cutting tool.

In another embodiment, the present invention can be an extension assembly for an existing pneumatic cutting tool. The extension assembly includes a connecting tube 20 (FIG. 1) having first and second ends, which the first end of the connecting tube 20 connected to the shaft 61 (FIG. 3). An extension rod 21 (FIG. 1) has ends 21*a* and 21*b*, where end 21*a* of the extension rod 21 is connected to the second end of the connecting tube 20. The cylinder 30 has a body end 38 and an operating end 39, where the body end 38 is appropriately threaded for connection to the opening of the body 60 (FIG. 3), and the extension rod 21 is rotatably fitted into the cylinder 30 (FIG. 1). The connecting tube 67 (FIG. 3) with the positioning collar 68 is attached to end 21*b* (FIG. 1) of the extension rod, and the protective cover is attached to the operating end 39 of the cylinder 30. Finally, the bolt 72 (FIG. 3) is used to attach the circular cutter 71 to the connecting tube 67. The extension assembly can further include the adjustable handle assembly previously described.

While a particular embodiment of the pneumatic cutting tool adopted for two handed operation in accordance with the present invention has been shown and described, it will be appreciated by those skilled in the art that changes and modifications may be made thereto without departing from the invention in its broader aspects and as set forth in the following claims.

What is claimed is:

1. A cutting tool comprising a body with an opening defined therein, and a trigger that can be actuated by a first hand, a protective cover connected to the body, a shaft rotatably mounted within the body, a positioning collar attached to the shaft, a circular cutter attached adjacent to the positioning collar, and an extension assembly, said extension assembly including a connecting tube having first and second ends, said first end of said connecting tube being connectable to the shaft when the positioning collar is removed from the shaft;

an extension rod having first and second ends, said first end of said extension rod being connectable to said second end of said connecting tube; and a cylinder having a body end and an operating end, said body end of said cylinder being connectable to the opening of the body, and said extension rod being rotatably fittable into said cylinder;

wherein the positioning collar is attachable to said second end of said extension rod, and the protective cover is attachable to said operating end of said cylinder, said extension assembly further having an adjustable handle assembly slidably mountable on said cylinder, said handle assembly having a handle that can be gripped by a second hand.

2. The cutting tool of claim 1, wherein said handle assembly includes a rotatable tube mountable onto a periphery of said cylinder, and a threaded rod operably connectable to said handle.

3. The cutting tool of claim 1, wherein said cylinder has a through hole defined therein for accommodating said connecting tube and said extension rod.

4. The cutting tool of claim 1, further comprising a pair of bearings mounted to said first and second ends of said extension rod, and abutting said cylinder.

* * * * *